US009349348B2

(12) United States Patent
Haruna et al.

(10) Patent No.: US 9,349,348 B2
(45) Date of Patent: May 24, 2016

(54) SYSTEM AND METHODS FOR LASER BEAM DISPLAY

(71) Applicant: HITACHI-LG DATA STORAGE, INC., Tokyo (JP)

(72) Inventors: Fumio Haruna, Yokohama (JP); Yuya Ogi, Tokyo (JP); Tomoki Kobori, Tokyo (JP); Yoshiho Seo, Tokyo (JP); Masayuki Hatori, Yokohama (JP); Toshio Ueda, Yokohama (JP)

(73) Assignee: HITACHI-LG DATA STORAGE, INC., Tokyo (JP)

( * ) Notice: Subject to any disclaimer, the term of this patent is extended or adjusted under 35 U.S.C. 154(b) by 0 days.

(21) Appl. No.: 14/132,034

(22) Filed: Dec. 18, 2013

(65) Prior Publication Data

US 2014/0192093 A1 Jul. 10, 2014

(30) Foreign Application Priority Data

Jan. 7, 2013 (JP) ..... 2013-000299

(51) Int. Cl.
*G09G 5/10* (2006.01)
*G09G 3/02* (2006.01)

(52) U.S. Cl.
CPC ..... *G09G 5/10* (2013.01); *G09G 3/025* (2013.01); *G09G 2320/0271* (2013.01); *G09G 2320/043* (2013.01); *G09G 2320/0606* (2013.01); *G09G 2320/0633* (2013.01); *G09G 2320/0673* (2013.01); *G09G 2360/144* (2013.01)

(58) Field of Classification Search
CPC ..... G09G 5/10; G09G 2320/043; G09G 2360/144
See application file for complete search history.

(56) References Cited

U.S. PATENT DOCUMENTS

| | | | | |
|---|---|---|---|---|
| 6,414,664 | B1 * | 7/2002 | Conover et al. | 345/89 |
| 6,445,362 | B1 * | 9/2002 | Tegreene | 345/7 |
| 7,242,377 | B2 * | 7/2007 | Mori | 345/77 |
| 8,040,433 | B2 * | 10/2011 | Matsui | H04N 5/46 348/441 |
| 8,605,764 | B1 * | 12/2013 | Rothaar et al. | 372/38.02 |
| 2002/0036650 | A1 * | 3/2002 | Kasahara et al. | 345/639 |
| 2002/0109693 | A1 * | 8/2002 | Champion | G06T 1/60 345/536 |
| 2009/0059179 | A1 * | 3/2009 | Kobori et al. | 353/52 |
| 2009/0160833 | A1 * | 6/2009 | Brown et al. | 345/207 |
| 2009/0161707 | A1 * | 6/2009 | Champion et al. | 372/29.011 |
| 2009/0256859 | A1 * | 10/2009 | Komorowski | H04N 5/2624 345/629 |

(Continued)

FOREIGN PATENT DOCUMENTS

JP 2006-343397 A 12/2006

*Primary Examiner* — Kumar Patel
*Assistant Examiner* — Sejoon Ahn
(74) *Attorney, Agent, or Firm* — Baker Botts L.L.P.

(57) ABSTRACT

A laser beam display device includes: a dimming setting input unit into which any one of the dimming values of plural dimming steps are input; a first dimming processing unit having plural dimming LUTs that store dimming amounts regarding the respective dimming steps with the corresponding gradation levels as indexes; a second dimming processing unit having one gain LUT that holds gains regarding the respective dimming steps and a multiplier that creates the indexes for the respective dimming LUTs by multiplying a video signal by the gains; and a light source drive unit that drives a laser diode on the basis of reference results obtained by referring to the dimming LUTs of the first dimming processing unit. The luminance of the emission beam of the laser diode, which corresponds to the video signal, is dimmed in accordance with a dimming setting input from the dimming setting input unit.

5 Claims, 3 Drawing Sheets

(56) References Cited

U.S. PATENT DOCUMENTS

2009/0315921 A1* 12/2009 Sakaigawa ..... G09G 3/2003 345/694
2010/0158407 A1* 6/2010 Standfield et al. ..... 382/270
2010/0165193 A1* 7/2010 Kanai ..... H04N 5/58 348/453
2010/0295879 A1* 11/2010 Tanaka et al. ..... 345/690
2011/0181634 A1* 7/2011 Higashi ..... G09G 3/3426 345/691
2011/0234569 A1* 9/2011 Ooishi et al. ..... 345/211
2013/0021393 A1* 1/2013 Combs ..... G09G 3/2074 345/694
2013/0050170 A1* 2/2013 Kimoto ..... 345/211
2013/0147777 A1* 6/2013 Lau et al. ..... 345/207
2014/0293245 A1* 10/2014 Tani ..... 353/85

* cited by examiner

SYSTEM AND METHODS FOR LASER BEAM DISPLAY

INCORPORATION BY REFERENCE

This application relates to and claims priority from Japanese Patent Application No. 2013-000299 filed on Jan. 7, 2013, the entire disclosure of which is incorporated herein by reference.

BACKGROUND

The present invention relates to a laser beam display device that uses a laser diode as a light source, and displays a gray-scale image by scanning a laser beam with the use of a deflection component, and at the same time, by modulating the laser intensity of the beam light in accordance with an input image.

Thanks to the improvement of semiconductor laser technology in recent years, a light output of high power with desired wavelength components has been available. In addition, thanks to the improvement of semiconductor components and the advancement of packaging technology and the like, the efficiency improvement of electro-photo conversion and the downsizing and price-reduction have been realized, with the result that semiconductor devices are now used for various applications. For example, a beam light with visible light wavelength components the emission amount of which is modulated by a video signal is disclosed in Japanese Unexamined Patent Application Publication No. 2006-343397, and this beam light reflected by a micro mirror, which monoaxially or biaxially vibrates with the use of MEMS (Micro Electro Mechanical System) technology, has been widely applied to an image display device that performs raster scanning on an object.

On the other hand, the drive current vs. light output power characteristic (I-L characteristic) of a laser diode (LD) used for a light source is involved with the emission region of an LED and the oscillation region of the laser diode, and it is necessary to apply a predefined threshold current to the laser diode in order for the laser diode to emit the laser light. In addition, it is known that the light output power in a laser oscillation region does not have an excellent linearity to the drive current. In addition, it is also known that this output power characteristic depends on each laser diode, and varies in accordance with the temperature and aged deterioration of the laser diode.

SUMMARY

Generally, the display luminance of a display device is controlled in accordance with the luminance of the device's use environment, so that the predefined image dynamic range of the display device is maintained. It is also necessary that the brightness of the screen of the laser beam display device according to the present invention should be adjusted extensively so as to display an image with appropriate brightness regardless of the intensity of external light.

For example in the case where the laser beam display device according to the present invention is applied to an in-vehicle head-up display, it is necessary that a sufficient light amount of the head-up device should be secured against direct sunlight or reflected sunlight in the daytime. On the other hand, it is necessary that the light amount of the head-up display should be suppressed lest the light of the head-up display should disturb the driver to the extent that he/she is bedazzled. It is also necessary that the light amount of the head-up display should be adjusted to any light amount between the above two light intensities in accordance with the environment surrounding the head-up display. In addition, it is also required that the display luminance of the head-up display should be controlled so as to quickly follow the variation of the environment light surrounding the head-up display.

However, in the related technologies, it is not easy that, in the modulation processing in which the emission amount of the laser diode with the above-described characteristic is modulated by a video signal, the reproducibility of the video signal is secured and at the same time, the luminance of the entire screen of the head-up display is dynamically and finely controlled while the white balance of the screen is being properly kept.

The present invention was achieved with the above-mentioned problem in mind, and the present invention discloses a technology that makes it possible to secure the reproducibility of a video signal regardless of the intensity of external light, and at the same time, makes it possible to control the luminance of the entire screen of the head-up display while keeping properly the white balance of the screen in the modulation processing in which the emission amount of the laser diode with the above-described characteristic is modulated by the video signal.

In order to solve the above-described problem, a laser beam display device in which semiconductor laser light emitted from a laser diode is modulatedly driven by a video signal, and an image corresponding to the video signal is displayed by scanning the emission beam of the laser diode, is disclosed in an embodiment of the present invention. The laser beam display device includes: a dimming setting input unit into which any one of the dimming values of plural dimming steps are input; a first dimming processing unit having plural dimming look-up tables that store dimming amounts regarding the respective dimming steps with the corresponding gradation levels as indexes; a second dimming processing unit having one gain look-up table that holds gains regarding the respective dimming steps and a multiplier that creates the indexes for the respective dimming look-up tables by multiplying the video signal by the gains; a light source drive unit that drives the laser diode on the basis of reference results obtained by referring to the dimming look-up tables of the first dimming processing unit. In addition, the luminance of the emission beam of the laser diode, which corresponds to the video signal, is dimmed in accordance with a dimming setting input from the dimming setting input unit.

According the present invention, because the beam luminance of laser light can be varied so as to follow the illuminance change of the laser beam display device's use environment, a high-quality display image can be projected regardless of the illuminance change of the laser beam display device's use environment.

DETAILED DESCRIPTION

In order for the a laser beam display device according to the present invention to be equipped with desired dimming settings DS (DS is a natural number), the laser beam display device is configured in such a way that the control range of the dimming settings DS (for example, the control range of the dimming settings DS is a range from ×1 to ×1/5000) is divided into N steps (N is an integer), and in the case where the dimming values of the N steps are respectively represented by dimming values dim (dim is any of 0 to N), continuous dimming using the dimming values 0 to N can be performed with the use of a combination of at least two pieces of dimming processing A and B.

In the dimming processing A, a dimming LUT, in which a dimming amount per each of the gradation levels of a video signal is predetermined so that the dimming amount is adjusted to fit the I-L characteristic of a laser diode, and the dimming amount is held, is prepared for each of the desired dimming settings DS. In this case, the dimming settings DS are discretely prepared. For example, the dimming settings DS are set to be ×1, ×1/4, ×1/16, ×1/64, ×/512, and ×1/2048. When the dimming amount falls within two discrete dimming settings DS, a dimming LUT for the larger dimming setting DS is referred to.

In the dimming processing B, there is a gain LUT, in which gains DG are predetermined on the basis of dimming values so that desired dimming setting DS can be obtained, and if the dimming value falls within two discrete dimming settings DS, the video signal is dimmed with the use of a gain DG obtained by referring to the gain LUT.

Hereinafter, an embodiment of the present will be described with reference to the accompanying drawings. In the following drawings and embodiment, components that have the same configurations, and the same functions or operations will be given the same referential numbers, and redundant description regarding these components will be omitted for avoiding overlap.

In addition, although numeric values will be limited to concrete values in the next embodiment, it goes without saying that desired dimming settings DS, dimming values dim, the number of dimming LUTs can be determined in the above-described manner in accordance with devices and applications to which the present invention is applied regardless of these concrete values.

First Embodiment

Figure 1:
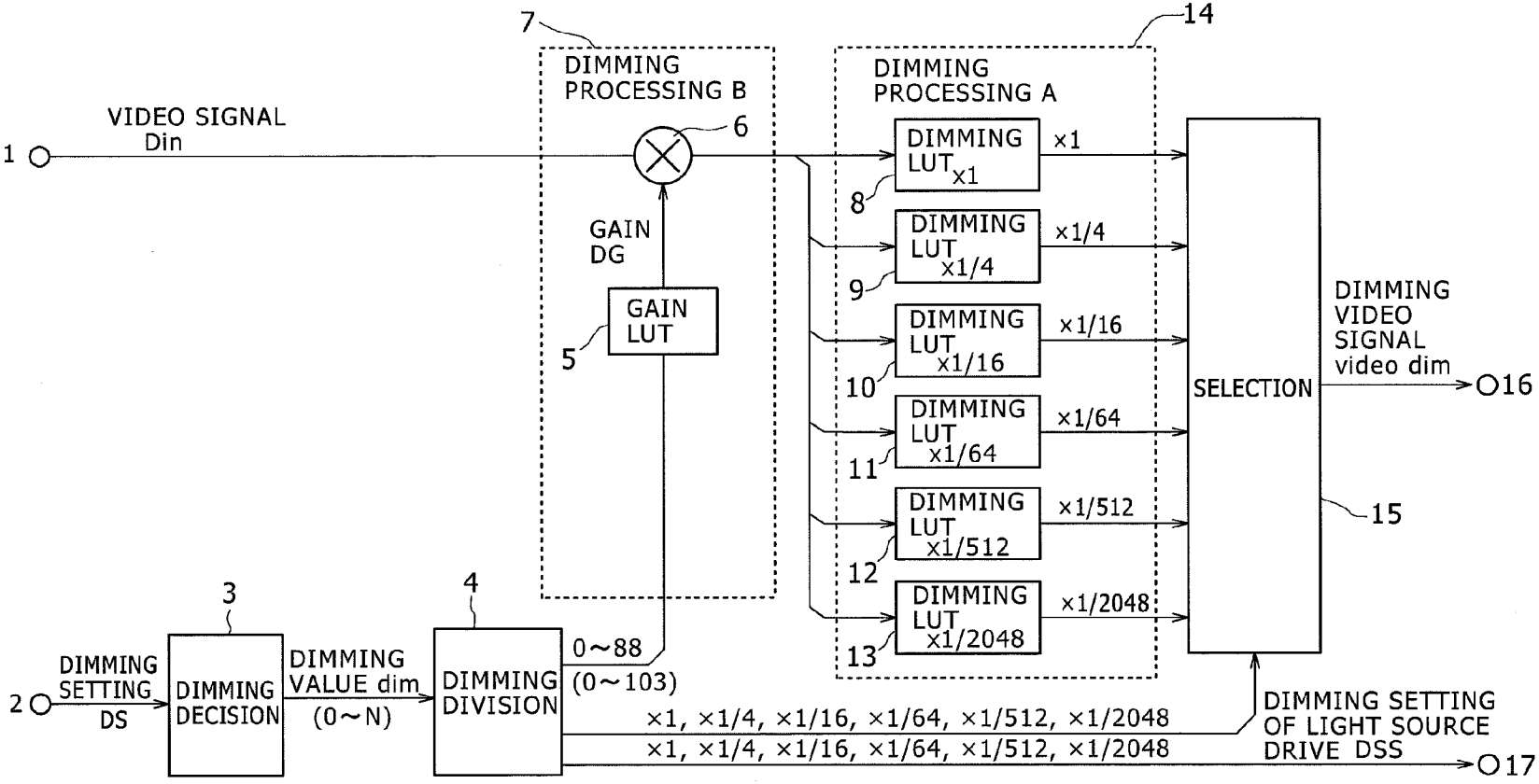
FIG. 1 is a control block diagram of dimming processing according to an embodiment of the present invention.

First, the operation outline of dimming processing will be described with reference to FIG. 1 and FIG. 2. The detection value of an external illuminance sensor and a setting value set by a user are input as a desired dimming setting DS. In this embodiment, dimming values 543 to 0 are assigned across the range from the maximum luminance ratio ×1 to ×1/5000 of the dimming settings DS. Hereinafter, an operation in which the dimming within the range from ×1 to ×1/5000 is continuously performed will be described.

To put it in detail, in a dimming decision unit 3, the setting range of the dimming settings DS×1 to ×1/5000 is divided into N steps is an integer, and it will be assumed that N=543 in this embodiment), that is, the dynamic range is 0 to N, and the dimming values dim (dim=0 to N) are decided by the dimming settings DS.

A dimming division unit 4 obtains a dimming value dim, and divides the dimming value dim into two parts, one part that is stepwise set to one discrete value among six discrete values (dimming settings DS=×1, ×1/4, ×1/16, ×1/64, ×1/512, and ×1/2048), and the other part that is stepwise set to one step among plural steps between two adjacent discrete values, that is, set to one step among SS steps. For example, the dimming setting DS is between ×1 and ×1/4, the dimming value is between 543 and 455. Therefore the discrete value for the dimming setting DS is ×1 and the step set between the discrete values ×1 and ×1/4 is within 88 steps (the number of SS steps is 88). Here, the attenuation ratio of the dimming setting DS×1/64 to the dimming setting DS×1/512 is 8, and the number of SS steps is 103.

In addition, the dimming division unit 4 configures drive conditions of a laser diode of a light source drive unit 26 for discrete step settings (×1, ×1/4, ×1/16, ×1/64, ×1/512, and ×1/2048) as dimming settings of light source drive DSS. Here, the drive conditions are a threshold current, the maximum drive current, and the like.

Although the dimming range has been divided by ratios of one over the nth power of 2 (n=0, 2, 4, 6, 9, and 11) as described above in this embodiment, ratios to be used are not limited to these ratios. However, the use of the ratios of this embodiment makes it easy to configure an after-mentioned gain LUT 5.

Figure 2:
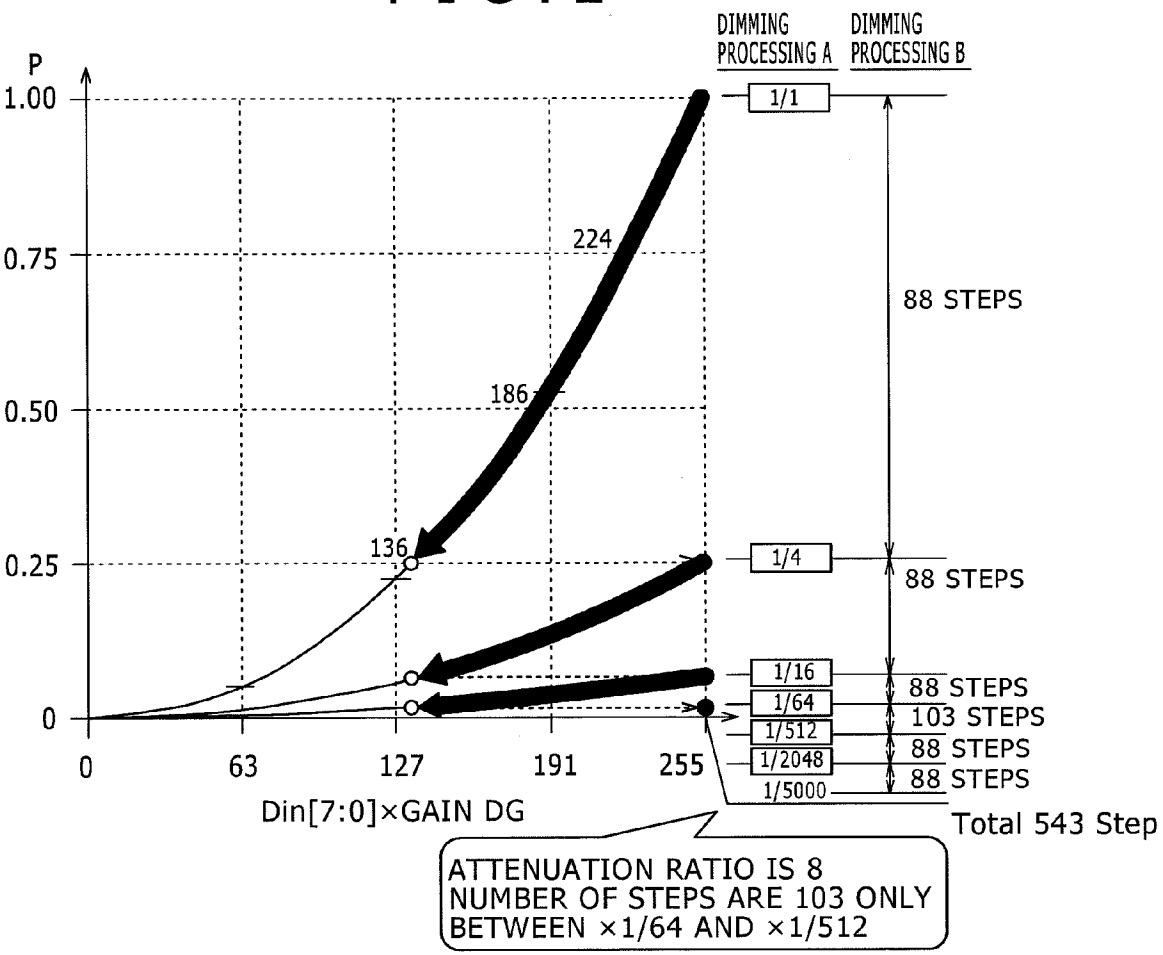
FIG. 2 is a diagram for explaining the outline of the dimming processing according to the embodiment of the present invention.

The dimming processing A is performed with the use of dimming LUTs 8 to 13, and, as shown by the curves in FIG. 2, each LUT holds table values that are predetermined so that a dimming amount per each of the gradation levels of a video signal is adjusted to fit the I-L characteristic of the laser diode of the light source drive unit 26 for the dimming settings DS of six discrete steps (×1, ×1/4, ×1/16, ×1/64, ×1/512, and ×1/2048).

The dimming processing B is performed with the use of the gain LUT 5 and a multiplier 6. To put it in detail, the gain LUT 5 predetermines gains DG for respective step values that show the step values of the plural steps between two adjacent discrete values (the step values of the SS steps) that are obtained by dividing a dimming value dim, and holds the gains. The dimming processing B is performed by multiplication in which the multiplier 6 multiplies a video signal Din with a gain DG obtained by referring to the step among plural steps between two adjacent discrete values obtained by the division performed by the dimming division 4. The dimming results are values within ranges shown by bold arrows on the curves in FIG. 2. Here, FIG. 2 shows the dimming results in the case where the video signal Din is digital data represented by 8 bits.

In addition, a dimming video signal video_dim is obtained by selecting one of the reference results of the dimming LUTs 8 to 13 that respectively correspond to the discrete steps (×1, ×1/4, ×1/16, ×1/64, ×1/512, and ×1/2048) of the dimming division unit 4. The gain DG can be configured in such a way that the gain DG depicts, for example, a curve of the 2.2 power.

For example, if a dimming setting DS is between ×1 and ×1/4, the gain dimming of a video signal Din can be performed with the use of one of gains DG obtained by dividing the region between ×1 and ×1/4 by 88 in the dimming processing B, and then the reference result of the dimming LUT 8 of the dimming setting DS=×1 is selected in the dimming processing A.

Although the numeric values have been limited to some concrete values in the above descriptions, it goes without saying that desired dimming settings DS, the dimming values dim, the number of dimming LUTs can be determined in the above-described manner in accordance with devices and applications to which the present invention is applied regardless of these concrete values.

According to this embodiment of the present invention, while the capacities of LUTs are being optimized, any dimming amount can be adjusted to fit the I-L characteristic of a laser diode. Therefore, the dimming necessary for the transition from an LD emission region to the LED emission region can be smoothly performed with the use of even a small number of LUTs. This embodiment of the present invention makes it possible to secure the reproducibility of a video signal, and at the same time, makes it possible to control the luminance of the entire screen dynamically and finely while keeping properly the white balance of the screen.

Next, the configuration of a display device in the case where the above-described dimming processing is applied to the display device will be described with reference to FIG. 3. To put it in detail, the configuration of the display device in the case where the above-described dimming control is applied to the display device, in which laser light is shined on MEMS mirrors that biaxially oscillate and the reflected lights are raster-scanned across an object to provide the projected image of the object, will be described.

In this embodiment, descriptions will be made under the assumption that a laser light source emitting a beam light, which can be easily light-amount modulated, is used as a light source. It goes without saying that a coherent light source can be used as a light source with the use of optical components that gathers coherent light to form beam-shaped light and modulation components used for modulating the light amount of the coherent light. In addition, how to control and drive oscillating mirrors 23 and 24 is not discussed in this embodiment, and any means that makes the mirrors to oscillate, such as an electromagnetic induction type means, a piezoelectric-type means, and an electrostatic-type means, can be used. Therefore, detailed descriptions regarding how to control and drive oscillating mirrors 23 and 24 are not made.

In addition, in this embodiment, for purposes of illustration, it will be assumed that a video signal of resolution XGA (1024×768 pixels) is used, and that the oscillating mirrors 23 and 24 oscillate monoaxially (that is, the oscillating mirrors are horizontally oscillating mirrors), their resonant frequencies are 30 kHz, and their diameters ϕL are 1.2 mm.

The oscillating mirrors 23 and 24 are vibrated by a 60 Hz slow oscillating signal v_drive and a 30 kHz high oscillating signal h_drive of a mirror control drive unit 22, and the oscillating angle of each mirror is adjusted by these oscillating signals.

An address generation unit 21 generates a frame start signal VM_sync for the video signal, a line start signal HM_sync for the video signal, a pixel clock (60 MHz) for the video signal, and a scan address scan_add for the video signal from an oscillation position signal H/V_sensor detected by the mirror control drive unit 22.

Although the address generation unit 21 receives a horizontal synchronization signal H_sync 60 Hz, and a vertical synchronization signal V_sync 60 Hz through an input terminal 20, and an input video signal video through an input terminal 19, if the horizontal synchronization signal H_sync and the vertical synchronization signal V_sync are not in synchronization with the frame start signal VM_sync and the line start signal HM_sync, the address generation unit 21 can convert the timings of the horizontal synchronization signal H_sync and the vertical synchronization signal V_sync so that these synchronization signals are in synchronization with the frame start signal VM_sync and the line start signal HM_sync. The video signal Din is a video signal per pixel read out from the input video signal video on the basis of the VM_sync and the HM_sync.

On the other hand, a dimming setting DS shown in the first embodiment will be determined with the use of external light detected by an illuminance sensor 18. For example, one of the dimming settings DS×1 (bright) to ×1/5000 (dark) is assigned to the external light in accordance with the luminance of the external light, and the dimming processing is performed on the video signal Din as described above. It goes without saying that the dimming processing is performed on video signals of R, G, and B respectively.

The light source drive unit 26 (which is assumed to be a commercially available laser drive IC) obtains the dimming video signal video_dim and the dimming setting of light source drive DSS, sets laser drive conditions, such as an optimal threshold current and the maximum drive current, for the discrete step setting (×1, ×1/4, ×1/16, ×1/64, ×1/512, or ×1/2048), and modulatedly drives the emission amounts of the RGB laser light sources 27*r*, 27*g*, and 27*b*.

Figure 3:
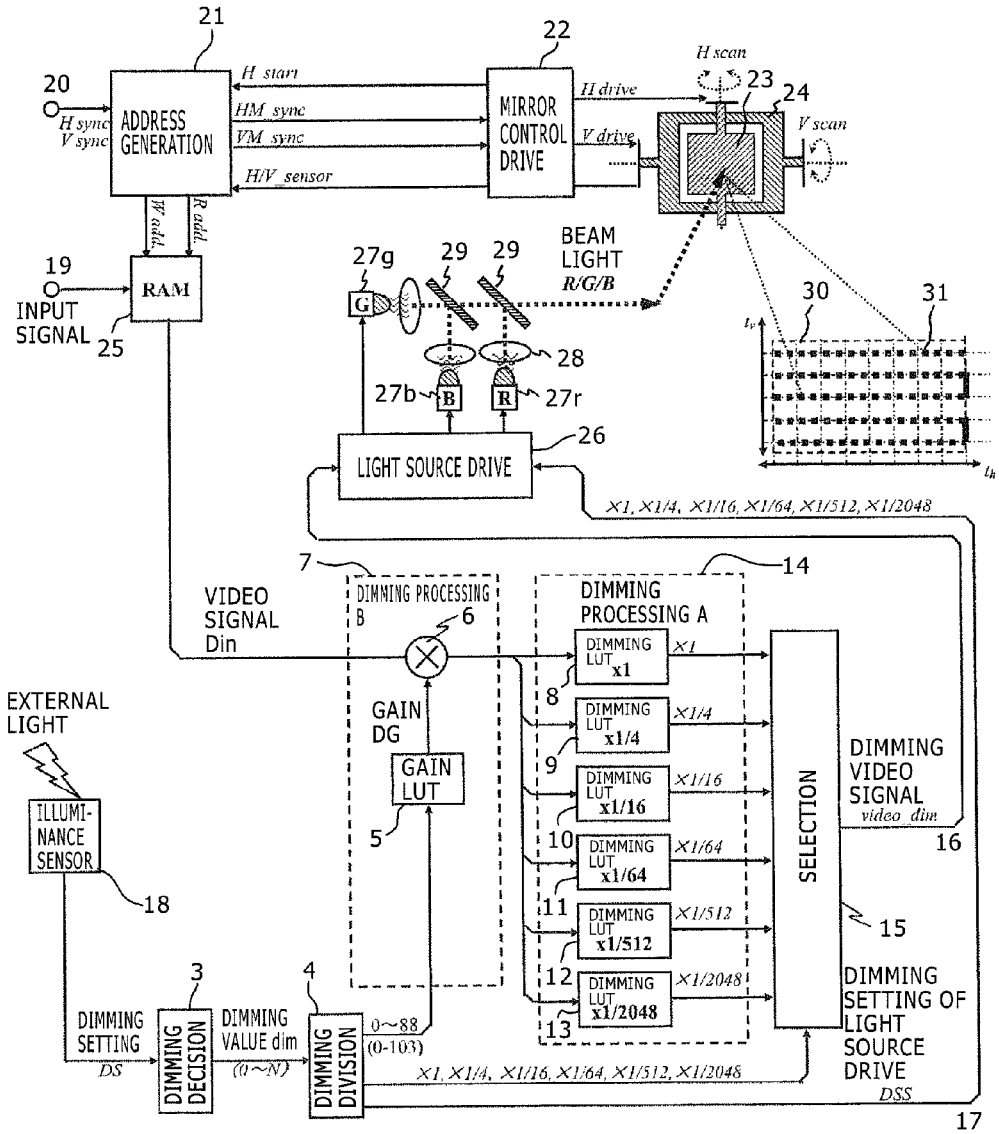
FIG. 3 is a block diagram of a laser beam display device according to the embodiment of the present invention.

In the configuration of the display device shown in FIG. 3, light fluxes of wavelengths λr (=630 nm), light fluxes of wavelengths λg (=530 nm), and light fluxes of wavelengths λb (=450 nm) are respectively gathered through corresponding collimating lenses so as to form parallel beam lights of wavelengths λr of diameter ϕ1 mm, those of wavelengths λg of diameter ϕ1 mm, and those of wavelengths λb of diameter ϕ1 mm. Dichroic mirrors changes these three kinds of parallel beam lights into parallel beam lights along the same axis, and these beam lights are reflected by biaxially oscillating mirrors 21 and 22, and the reflected beam lights are projected and displayed on a display area 30 through a raster scanning trajectory 31.

According to this embodiment of the present invention, while the capacities of LUTs are being optimized, any dimming amount can be adjusted to fit the I-L characteristic of a laser diode. Therefore, the dimming necessary for the transition from an LD emission region to the LED emission region can be smoothly performed in a screen display device to which MEMS technology is applied. This embodiment of the present invention makes it possible to secure the reproducibility of a video signal, and at the same time, makes it possible to control the luminance of the entire screen dynamically and finely while keeping properly the white balance of the screen. In addition, dimming processing performed for an in-vehicle HD (head-up display) can be performed only by controlling signal processing.

What is claimed is:

1. A laser beam display device in which semiconductor laser light emitted from a laser diode is modulated by a video signal to emit an emission beam, and an image corresponding to the video signal is displayed by scanning the emission beam, the laser beam display device comprising:

one or more memories; a dimming processing circuit coupled to the one or more memories and configured to:

receive a dimming setting corresponding to one of a plurality of dimming steps is input;

store a plurality of dimming look-up tables each corresponding to one or more of the plurality of dimming steps, each dimming look-up table storing a dimming amount for each of a plurality of gradation levels of the video signal at indexes of the table;

store a gain look-up table that holds a gain value corresponding to each of the dimming steps and a multiplier that select one of the indexes of the dimming look-up tables by multiplying the video signal by the gain value; and drive the laser diode using the selected one of the indexes of the dimming look-up tables, wherein a luminance of the emission beam of the laser diode, which corresponds to the video signal, is dimmed in accordance with the dimming step, wherein the dimming step comprises two dimming step parts, the first dimming step part comprising one of a plurality of discrete values and the second dimming step part comprising one of a plurality of steps between two adjacent discrete values, and wherein each of the plurality of dimming look-up tables corresponds to the first dimming step part and the gain value corresponds to the second dimming step part.

2. The device of claim 1, wherein the dimming setting comprises a luminance detection value from an external luminance sensor.

3. The device of claim 1, wherein the dimming setting comprises a setting value set by a user.

4. The device of claim 1, wherein the dimming amounts for each gradation levels of the video signal corresponds to a drive current compared to light output power characteristic of the laser diode.

5. The device of claim 1, wherein the dimming processing circuit to select one of the plurality of look-up tables corresponding to the dimming step and output the selected one of the indexes corresponding to the selected one of the plurality of look-up tables to drive the laser diode.

* * * * *